US009361899B2

(12) United States Patent
Lainez et al.

(10) Patent No.: US 9,361,899 B2
(45) Date of Patent: Jun. 7, 2016

(54) SYSTEM AND METHOD FOR COMPRESSED DOMAIN ESTIMATION OF THE SIGNAL TO NOISE RATIO OF A CODED SPEECH SIGNAL

(71) Applicant: Nuance Communications, Inc., Burlington, MA (US)

(72) Inventors: Jose Lainez, London (GB); Daniel A. Barreda, London (GB); Dushyant Sharma, Marlow (GB); Patrick Naylor, Reading (GB); Sridhar Pilli, Fremont, CA (US)

(73) Assignee: Nuance Communications, Inc., Burlington, MA (US)

( * ) Notice: Subject to any disclaimer, the term of this patent is extended or adjusted under 35 U.S.C. 154(b) by 177 days.

(21) Appl. No.: 14/322,369

(22) Filed: Jul. 2, 2014

(65) Prior Publication Data

US 2016/0005414 A1 Jan. 7, 2016

(51) Int. Cl.

| | |
|---|---|
| ***G10L 21/00*** | (2013.01) |
| ***G10L 19/028*** | (2013.01) |
| ***G10L 19/002*** | (2013.01) |
| ***G10L 25/18*** | (2013.01) |
| ***G10L 25/90*** | (2013.01) |
| *G10L 19/00* | (2013.01) |

(52) U.S. Cl.

CPC ..... *G10L 19/028* (2013.01); *G10L 19/002* (2013.01); *G10L 25/18* (2013.01); *G10L 25/90* (2013.01); *G10L 2019/0002* (2013.01); *G10L 2019/0006* (2013.01)

(58) Field of Classification Search

USPC ..... 704/214, 219, 223, 226, 227, 228, 233, 704/243, 244, 500, 501, 502, 503, E19.013

See application file for complete search history.

(56) References Cited

U.S. PATENT DOCUMENTS

| | | | | |
|---|---|---|---|---|
| 5,680,508 | A * | 10/1997 | Liu | G10L 19/04 704/227 |
| 5,924,065 | A * | 7/1999 | Eberman | G10L 21/0208 704/222 |
| 6,003,003 | A * | 12/1999 | Asghar | G10L 15/02 704/243 |
| 6,493,665 | B1 * | 12/2002 | Su | G10L 19/005 704/220 |
| 6,658,112 | B1 * | 12/2003 | Barron | G10L 19/005 375/229 |
| 6,813,602 | B2 * | 11/2004 | Thyssen | G10L 19/005 704/222 |
| 7,596,491 | B1 * | 9/2009 | Stachurski | G10L 19/24 704/203 |

(Continued)

OTHER PUBLICATIONS

Wang et al., ("Stanag 4591—the winner! A 1200/2400 BPS Coding Suite Based on MELP" (Mixed Excitation Linear Prediction) The Institute of Engineering & Technology, NC3A Workshop on Stanag 4591, The Hague, Powerpoint Presentation, pp. 1-17, Oct. 18, 2002).*

(Continued)

*Primary Examiner* — Edgar Guerra-Erazo

(74) *Attorney, Agent, or Firm* — Mark H. Whittenberger, Esq.; Holland & Knight LLP

(57) ABSTRACT

The present disclosure is directed towards a process for estimating the signal to noise ratio of a speech signal. The process may include receiving, at a computing device, a speech signal having a bitstream and a signal-to-noise ratio ("SNR") associated therewith. The process may further include estimating the SNR directly from the bitstream or using a partial decoder that is configured to extract one or more parameters, the parameters including at least one of a fixed codebook gain, an adaptive codebook gain, a pitch lag, and a line spectral frequency ("LSF") coefficient.

20 Claims, 4 Drawing Sheets

(56) References Cited

U.S. PATENT DOCUMENTS

| | | | | |
|---|---|---|---|---|
| 8,447,594 | B2 * | 5/2013 | Massimino | G10L 19/04 704/222 |
| 9,236,057 | B2 * | 1/2016 | Kim | G10L 19/028 |
| 2003/0033143 | A1 * | 2/2003 | Aronowitz | G10L 15/20 704/233 |
| 2005/0080623 | A1 * | 4/2005 | Furui | G10L 15/065 704/233 |
| 2011/0184732 | A1 | 7/2011 | Godavarti | |

OTHER PUBLICATIONS

Srinivasan et al., (S. Srinivasan, J. Samuelsson, W.B. Kleijn. Speech enhancement using a-priori information with classified noise codebooks, Proc. EUSIPCO (2004) pp. 1461-1464).*

* cited by examiner

400

SYSTEM AND METHOD FOR COMPRESSED DOMAIN ESTIMATION OF THE SIGNAL TO NOISE RATIO OF A CODED SPEECH SIGNAL

TECHNICAL FIELD

This disclosure relates to signal processing systems and, more particularly, to systems and methods for estimating the signal to noise ratio of a coded speech signal without applying a decoder.

BACKGROUND

In a telecommunication system, it is often necessary to measure the Signal to Noise Ratio ("SNR") of a speech signal. SNR is a measure that quantifies the level of background noise in a speech signal and is related to the perceptual speech quality. This might be needed, for example, for assuring quality of service in network gateways, or to determine whether a speech signal is suitable or not for automatic speech recognition, or to determine whether noise reduction should or should not be applied in the network. In telephone networks, speech is transmitted in a coded form such as adaptive multi-rate ("AMR"), global system for Mobile Communication ("GSM"), etc. In order to measure the SNR it is normally necessary to decode the signal first to linear pulse code modulation ("PCM") and then apply a non-intrusive (single-ended) SNR estimation algorithm. The decoding task adds additional computation complexity that, when deployed on networks carrying high volume traffic, becomes itself a significant computational overhead.

SUMMARY OF DISCLOSURE

In one implementation, a method for estimating the signal to noise ratio of a speech signal is provided. The method may include receiving, at a computing device, a speech signal having a bitstream and a signal-to-noise ratio ("SNR") associated therewith. The method may further include estimating the SNR directly from the bitstream or using a partial decoder that is configured to extract one or more parameters, the parameters including at least one of a fixed codebook gain, an adaptive codebook gain, a pitch lag, and a line spectral frequency ("LSF") coefficient.

One or more of the following features may be included. In some embodiments, the method may include determining if the SNR is above a pre-defined threshold. The method may also include determining an amount of energy associated with each packet of the received speech signal using an energy predictor that includes a feature extractor and a regressor. The feature extractor may include the one or more parameters, a difference of contiguous LSFs, and a logarithm of summed fixed codebook gains for all subframes. The regressor may include a classification and regression tree ("CART") or a deep belief network ("DBN"). The method may further include training one or more energy regressor models with a labeled database. The method may also include storing a sequence of energies at a buffering stage. The method may include applying a 2-component Gaussian mixture model ("GMM") estimator including an expectation-maximization ("EM") algorithm. The EM algorithm may be executed during a test phase and does not require pre-trained models. A buffered sequence of energies in dB may be an input to the Gaussian mixture model estimator is the buffered sequence of energies in dB. A mean of each gaussian component may be initialized with a minimum energy plus a random offset, and with a maximum energy minus a random offset. A difference of means of the 2-component Gaussian mixture model ("GMM") estimator may be an estimate of the SNR of the speech signal. The method may further include computing a confidence of an SNR estimation using a machine learning module associated with a confidence estimator. The confidence estimator may be configured to analyze a feature vector including a variance and a weight of each of the 2-component Gaussian mixture model, and the estimated SNR. The confidence estimator may include a regressor, the regressor including at least one of a classification and regression tree ("CART") or a deep belief network ("DBN"). The regressor may include a training process.

In another implementation, a system for estimating the signal to noise ratio of a speech signal is provided. The system may include one or more computing devices configured to receive a speech signal having a bitstream and a signal-to-noise ratio ("SNR") associated therewith. The one or more computing devices may be further configured to estimate the SNR directly from the bitstream or using a partial decoder that is configured to extract one or more parameters. The parameters may include at least one of a fixed codebook gain, an adaptive codebook gain, a pitch lag, and a line spectral frequency ("LSF") coefficient.

One or more of the following features may be included. In some embodiments, the one or more processors may be further configured to determine an amount of energy associated with each packet of the received speech signal using an energy predictor that includes a feature extractor and a regressor. The one or more processors may be further configured to apply a 2-component Gaussian mixture model ("GMM") estimator including an expectation-maximization ("EM") algorithm. The one or more processors may be further configured to compute a confidence of an SNR estimation using a machine learning module associated with a confidence estimator.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings may indicate like elements.

DETAILED DESCRIPTION

Embodiments provided herein are directed towards addressing the problem of estimating the SNR of a coded speech signal without decoding the signal into a linear PCM. Accordingly, estimation process 10 described herein may operate on a compressed domain (e.g., working directly on the bitstream data or a partial decoded representation). In this way, estimation process 10 may be configured to estimate the SNR at a fraction of the computational complexity of current PCM based methods that rely on a full decoding of the speech signal.

Embodiments of estimation process 10 may be configured to estimate the SNR of a speech signal, which may be used dynamically (e.g. using the Voice Quality Assurance ("VQA") products available from the Assignee of the present disclosure) to control the level of noise reduction applied, so that when the SNR is already good, the noise reduction module may be switched off thereby providing significant cost of goods sold ("COGS") reduction. Trying to do this by first decoding to PCM may incur a significant computational overhead that may effectively counter-balance the computational complexity benefit of switching of the noise reduction, making the approach near useless. However, estimation process 10, described in further detail below, may be configured to operate directly on the bitstream (e.g., without decoding to PCM), which may provide significant benefits in computational complexity. This may be particularly important as certain products (e.g. VQA) may need to process 1000's of simultaneous voice-calls per processor core.

Figure 1:
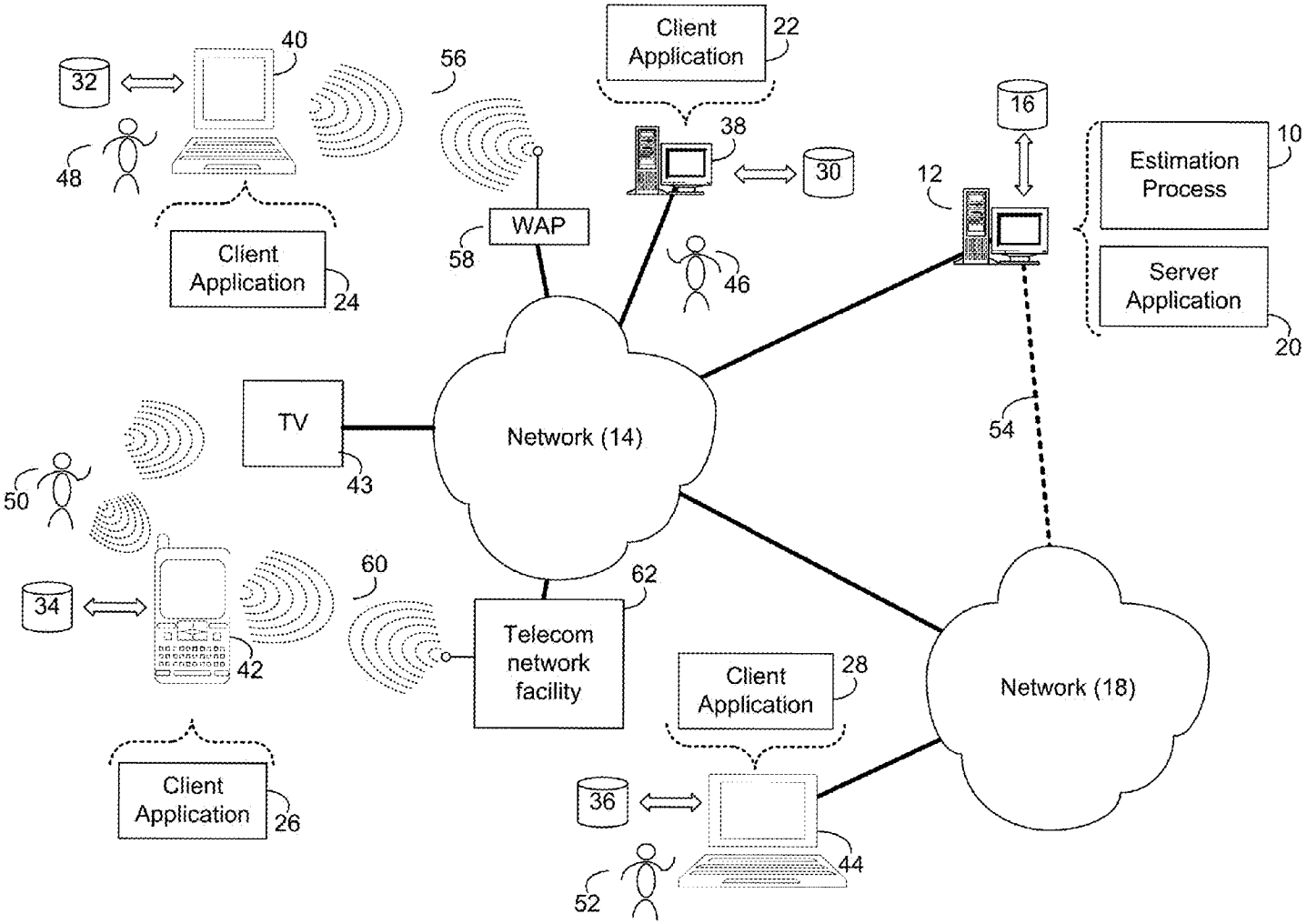
FIG. 1 is a diagrammatic view of an estimation process in accordance with an embodiment of the present disclosure.
Figure 2:
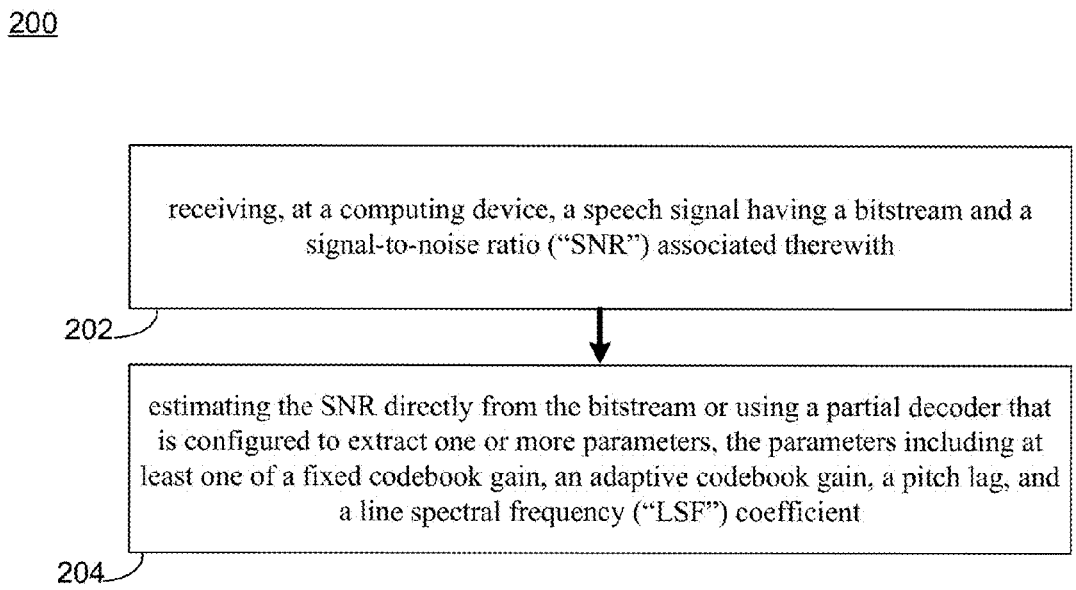
FIG. 2 is a flowchart of an estimation process in accordance with an embodiment of the present disclosure.

Referring to FIG. 1, there is shown an estimation process 10 that may reside on and may be executed by computer 12, which may be connected to network 14 (e.g., the Internet or a local area network). Server application 20 may include some or all of the elements of speech intelligibility process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example. Some of all of the devices shown in FIG. 1 may include various audio processing components that may be configured to allow for audio communication over network 14.

As will be discussed below in greater detail below and in the Figures, estimation process 10 may include receiving (202), at a computing device, a speech signal having a bitstream and a signal-to-noise ratio ("SNR") associated therewith. The process may further include estimating (204) the SNR directly from the bitstream or using a partial decoder that is configured to extract one or more parameters, the parameters including at least one of a fixed codebook gain, an adaptive codebook gain, a pitch lag, and a line spectral frequency ("LSF") coefficient. Numerous additional features may also be included as discussed in further detail below.

The instruction sets and subroutines of estimation process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to, a local area network, a wide area network, a telecommunications network, or an intranet, for example.

In some embodiments, estimation process 10 may reside in whole or in part on one or more client devices and, as such, may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), and a dedicated network device (not shown).

One or more of client applications 22, 24, 26, 28 may be configured to effectuate some or all of the functionality of estimation process 10. Accordingly, estimation process 10 may be a purely server-side application, a purely client-side application, or a hybrid server-side/client-side application that is cooperatively executed by one or more of client applications 22, 24, 26, 28 and estimation process 10.

Client electronic devices 38, 40, 42, 44 may each execute an operating system, examples of which may include but are not limited to Apple iOS™, Microsoft Windows™, Android™, Redhat Linux™, or a custom operating system.

Users 46, 48, 50, 52 may access computer 12 and estimation process 10 directly through network 14 or through secondary network 18. Further, computer 12 may be connected to network 14 through secondary network 18, as illustrated with phantom link line 54. In some embodiments, users may access estimation process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14.

Figure 3:
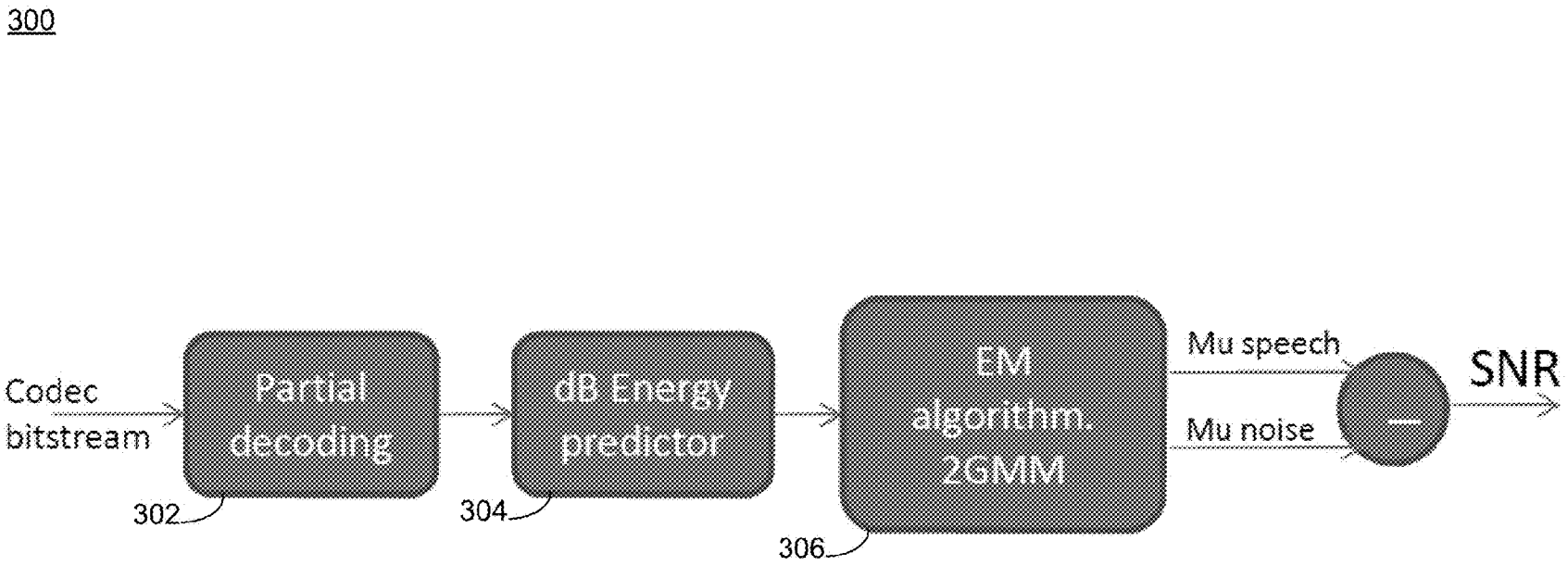
FIG. 3 is a diagrammatic view of an estimation process in accordance with an embodiment of the present disclosure.
Figure 4:
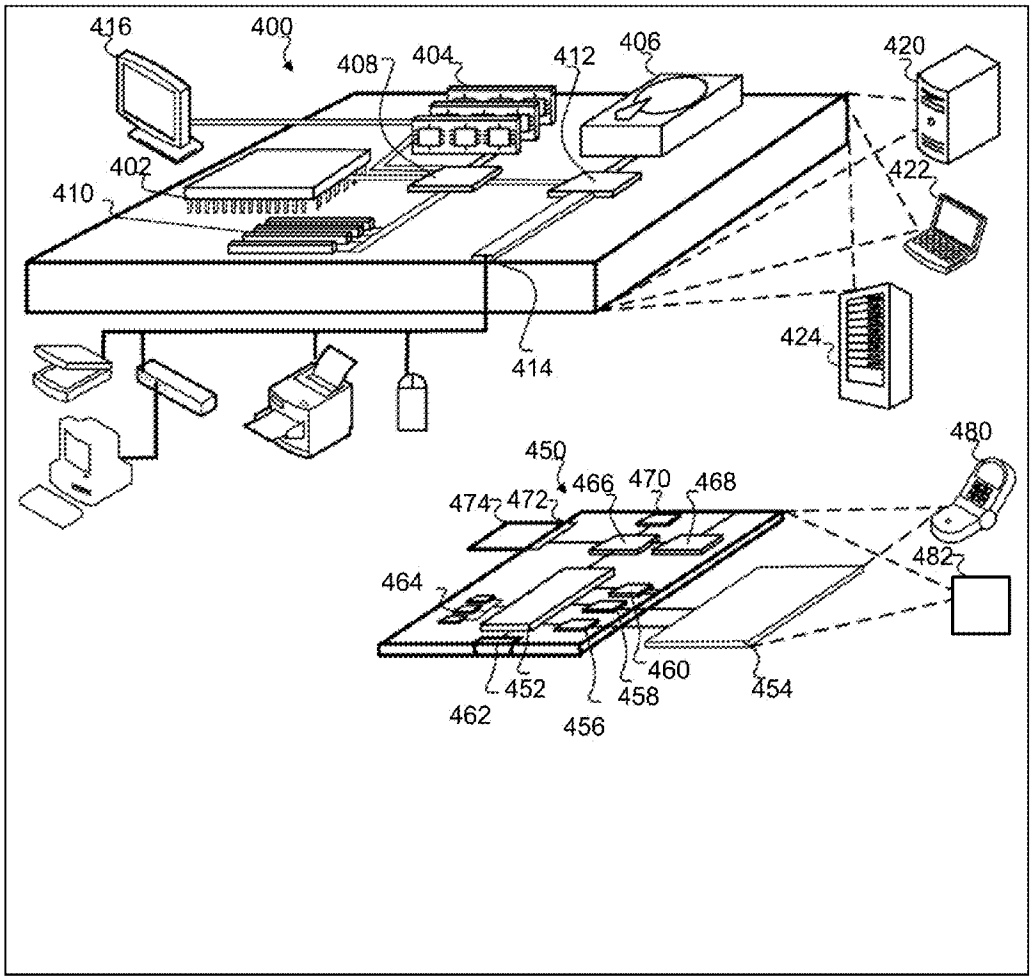
FIG. 4 shows an example of a computer device and a mobile computer device that can be used to implement embodiments of the present disclosure.

Referring also to FIGS. 3-4, embodiments consistent with estimation process 10 are provided. Current state of the art SNR estimators operate on a fully decoded, linear PCM signal, by estimating the noise power from a frequency spectrum representation, or assisted by a voice activity detector (VAD). The result is high computational cost and processing delay, as the signal must be first decoded into linear PCM, then a noise power spectrum may be estimated.

Estimation process 10 may be configured to estimate the SNR directly from the bitstream or from a partial decoding 302 representation (which for the code excited linear prediction ("CELP") class of codec may include, but is not limited to, extraction of the line spectral frequencies (LSFs), fixed codebook gains, adaptive codebook gains and pitch lag). This approach may result in significantly lower computational cost and processing delay.

Embodiments of the present disclosure may use one or more VAD algorithms. Additional information regarding VAD may be found in United States Patent Publication Number 2011/0184732 having an application Ser. No. 13/079,705, which is incorporated herein by reference in its entirety.

In some embodiments, estimation process 10 may assume that the logarithm of the energy of the frames of the noise process may be modeled with a Gaussian univariate continuous random variable, alike the energy of the frames of the speech process. The observable sequence of energy values is a mixture of contributions of the speech and the noise random variables. Under this assumption, an expectation-maximization ("EM") algorithm 306 may be applied to learn the parameters of a 2 component GMM of the observable energy sequence, then one Gaussian is supposed to model the noise and the other the speech. In some embodiments, the EM algorithm may include an iterative method for finding maximum likelihood ("ML") or maximum a posteriori ("MAP") estimates of parameters in statistical models, where the model depends on unobserved latent variables. The GMM may be usually trained using the EM algorithm.

In some embodiments, the difference of the means of the two Gaussians is the estimated SNR. The energy may be predicted very efficiently from the bitstream or from a partially decoded representation by means of a Classification and Regression Tree (CART) or a neural network algorithm.

In some embodiments, estimation process 10 may include an energy predictor 304 that extracts the energy from the bitstream (e.g. in dB) or from a partial decoding representation. As discussed above, estimation process 10 may also include an EM algorithm that learns the parameters of a 2 component GMM that models the energy distribution in an audio segment. The difference of the means of the 2 component GMM is the estimated SNR.

In some embodiments, and as discussed above, the energy predictor may be a CART or a neural network that uses as input features either the bitstream directly, or an intermediate representation of the codec parameters. Estimation process 10 may use a partial decoding representation with the adaptive codebook gains, the fixed codebook gains, the line spectral frequencies, and the pitch lag as intermediate representation to improve the energy predictor.

In some embodiments, the energy predictor models may be trained by using a database that can be automatically labeled by extracting the real energy from the PCM audio signals. The process for training the energy predictor may include extracting the localized log energy in frames (e.g., 20 ms) for each file in an audio database. The process may also include encoding each audio file and extracting the features that may be used as input to the energy predictor. The features can include the coded bitstream directly or a partial decoding representation. Using the features and the energy extracted above as a target, train the energy predictor.

In some embodiments, energy predictor module 304 may be configured to determine the energy of each packet. Energy predictor 304 may include a feature extractor and a regressor. In some embodiments, the feature extractor of the energy predictor may include the partial decoding parameters, the difference of contiguous LSFs, and the logarithm of the summed fixed codebook gains for all the subframes. The regressor used by the energy predictor may be a CART or a DBN with a linear layer on the top of it.

In some embodiments, the energy regressor models may be trained with a labeled database. The labeling process may be automatic and may not require human intervention. A database with several hours of audio may be prepared. The energy of time intervals (e.g., 10 or 20 ms—this interval represents the packet length and will depend on the codec, for example in G.729 is 10 ms and in AMR is 20 ms) may be extracted for each frame of all the audio files. The audio files may be encoded, and partially decoded extracting the feature vectors described above. Using the pairs feature vector/labels, a model may be trained that may be used in test phase. The training algorithm may depend upon the regressor algorithm chosen.

In some embodiments, estimation process 10 may include a buffering stage configured to store the sequence of energies. The buffer size may be configurable and should be chosen according to the desired estimation accuracy and delay. For example, a recommended minimum buffer size may be 1 second.

In some embodiments, estimation process 10 may include a two component Gaussian mixture model (GMM) estimation module, carried out with the EM algorithm. The EM algorithm may be executed in the test phase and may not require pre-trained models. The input to the Gaussian mixture model estimation may include the buffered sequence of energies in dB. The two means of each Gaussian component may be initialized with the minimum energy plus a random offset, and with the maximum energy minus a random offset.

In some embodiments, the difference of means of the two components estimated using the GMM estimation module is the actual signal-to-noise ratio estimation.

Estimation process 10 may include a machine learning module that computes the confidence of the SNR estimations. The feature vector used by the confidence estimator may include the variances and the weights of the two GMM components, and the estimated SNR. The regressor used by the confidence estimator may include a CART or a regression DBN. The regressor may utilize a training process.

As discussed above, SNR estimators usually operate on a fully decoded linear PCM signal, whereas estimation process 10 may be configured to operate from the bitstream or from a partial decoding representation. The combination of an efficient energy predictor from the bitstream with an Expectation-Maximization (EM) algorithm to learn a two component Gaussian Mixture Model (GMM) results in a low computational complexity SNR estimator. For example, in the AMR codec, the whole SNR estimation process of estimation process 10 may require only 0.3 MIPS, whereas only the decoding process into the PCM requires around 1.8 MIPS. Therefore, estimation process 10 provides a computational saving of at least 1.5 MIPS (i.e. 6 times faster) compared with any PCM based method.

In some embodiments, estimation process 10 may be used in network environments in a wide range of applications (e.g., even outside of the noise reduction paradigm). Some of these may include, but are not limited to, assuring quality of service in network gateways, determining whether a speech signal is suitable or not for automatic speech recognition, and/or determining whether noise reduction should or should not be applied in the network. For example, in the context of the VQA product available from the Assignee of the present disclosure, estimation process 10 may help control the Adaptive Noise Reduction (ANR) module dynamically and thereby provide significant COGS reduction. It is known that only a fraction of all telephone calls processed by VQA actually require ANR treatment, depending on the origin of the call. Estimation process 10 may be configured to deliver significant COGS reduction by allowing the VQA equipment to support many more calls (e.g., by not processing the calls where the SNR is above a given threshold). In contrast, the current, linear PCM based ANR module in VQA consumes around 2 MIPS.

Additionally and/or alternatively, estimation process 10 may be used as a measure of the quality of a communication and may modify the bitrate when severe noise conditions are found, giving significant bandwidth reduction for a telecommunications operator, without a loss of the quality of service.

Referring now to FIG. 4, an example of a generic computer device 400 and a generic mobile computer device 450, which may be used with the techniques described herein is provided. Computing device 400 is intended to represent various forms of digital computers, such as tablet computers, laptops, desktops, workstations, personal digital assistants, servers, blade servers, mainframes, and other appropriate computers. In some embodiments, computing device 450 can include various forms of mobile devices, such as personal digital assistants, cellular telephones, smartphones, and other similar computing devices. Computing device 450 and/or computing device 400 may also include other devices, such as televisions with one or more processors embedded therein or attached thereto. The components shown here, their connections and relationships, and their functions, are meant to be exemplary only, and are not meant to limit implementations of the inventions described and/or claimed in this document.

In some embodiments, computing device 400 may include processor 402, memory 404, a storage device 406, a high-speed interface 408 connecting to memory 404 and high-speed expansion ports 410, and a low speed interface 412 connecting to low speed bus 414 and storage device 406. Each of the components 402, 404, 406, 408, 410, and 412, may be interconnected using various busses, and may be mounted on a common motherboard or in other manners as appropriate. The processor 402 can process instructions for execution within the computing device 1800, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multiprocessor system).

Memory 404 may store information within the computing device 400. In one implementation, the memory 404 may be a volatile memory unit or units. In another implementation, the memory 404 may be a non-volatile memory unit or units. The memory 404 may also be another form of computer-readable medium, such as a magnetic or optical disk.

Storage device 406 may be capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, memory on processor 402, or a propagated signal.

High speed controller 408 may manage bandwidth-intensive operations for the computing device 400, while the low speed controller 412 may manage lower bandwidth-intensive operations. Such allocation of functions is exemplary only. In one implementation, the high-speed controller 408 may be coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 may include a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, may be interconnected using various buses, and several of the components may be mounted on a common motherboard or in other manners as appropriate.

Processor 452 may execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

In some embodiments, processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provide in communication with processor 452, so as to enable near area communication of device 450 with other devices. External interface 462 may provide, for example, for wired communication in some implementations, or for wireless communication in other implementations, and multiple interfaces may also be used.

In some embodiments, memory 464 may store information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provide as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 464, expansion memory 474, memory on processor 452, or a propagated signal that may be received, for example, over transceiver 468 or external interface 462.

Device 450 may communicate wirelessly through communication interface 466, which may include digital signal processing circuitry where necessary. Communication interface 466 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 468. In addition, short-range communication may occur, such as using a Bluetooth, WiFi, or other such transceiver (not shown). In addition, GPS (Global Positioning System) receiver module 470 may provide additional navigation- and location-related wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

Computing device 450 may be implemented in a number of different forms, as shown in the figure. For example, it may be implemented as a cellular telephone 480. It may also be implemented as part of a smartphone 482, personal digital assistant, remote control, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A method comprising:

receiving, at a computing device, a speech signal having a bitstream and a signal-to-noise ratio ("SNR") associated therewith; and estimating the SNR directly from the bitstream or using a partial decoder that is configured to extract one or more parameters, the parameters including at least one of a fixed codebook gain, an adaptive codebook gain, a pitch lag, and a line spectral frequency ("LSF") coefficient.

2. The method of claim 1, further comprising:

determining if the SNR is above a pre-defined threshold.

3. The method of claim 1, further comprising:

determining an amount of energy associated with each packet of the received speech signal using an energy predictor that includes a feature extractor and a regressor.

4. The method of claim 3, wherein the feature extractor includes the one or more parameters, a difference of contiguous LSFs, and a logarithm of summed fixed codebook gains for all subframes.

5. The method of claim 3, wherein the regressor includes a classification and regression tree ("CART") or a deep belief network ("DBN").

6. The method of claim 3, further comprising:

training one or more energy regressor models with a labeled database.

7. The method of claim 3, further comprising:

storing a sequence of energies at a buffering stage.

8. The method of claim 1, further comprising:

applying a 2-component Gaussian mixture model ("GMM") estimator including an expectation-maximization ("EM") algorithm.

9. The method of claim 8, wherein the EM algorithm is executed during a test phase and does not require pre-trained models.

10. The method of claim 8, wherein a buffered sequence of energies in dB is an input to the Gaussian mixture model estimator is the buffered sequence of energies in dB.

11. The method of claim 8, wherein a mean of each gaussian component is initialized with a minimum energy plus a random offset, and with a maximum energy minus a random offset.

12. The method of claim 8, wherein a difference of means of the 2-component Gaussian mixture model ("GMM") estimator is an estimate of the SNR of the speech signal.

13. The method of claim 1, further comprising:

computing a confidence of an SNR estimation using a machine learning module associated with a confidence estimator.

14. The method of claim 13, wherein the confidence estimator is configured to analyze a feature vector including a variance and a weight of each of the 2-component Gaussian mixture model, and the estimated SNR.

15. The method of claim 13, wherein the confidence estimator includes a regressor, the regressor including at least one of a classification and regression tree ("CART") or a deep belief network ("DBN").

16. The method of claim 15, wherein the regressor includes a training process.

17. A system comprising:

one or more computing devices configured to receive a speech signal having a bitstream and a signal-to-noise ratio ("SNR") associated therewith, the one or more computing devices being further configured to estimate the SNR directly from the bitstream or using a partial decoder that is configured to extract one or more parameters, the parameters including at least one of a fixed codebook gain, an adaptive codebook gain, a pitch lag, and a line spectral frequency ("LSF") coefficient.

18. The system of claim 17, wherein the one or more processors are further configured to determine an amount of energy associated with each packet of the received speech signal using an energy predictor that includes a feature extractor and a regressor.

19. The system of claim 17, wherein the one or more processors are further configured to apply a 2-component Gaussian mixture model ("GMM") estimator including an expectation-maximization ("EM") algorithm.

20. The system of claim 17, wherein the one or more processors are further configured to compute a confidence of an SNR estimation using a machine learning module associated with a confidence estimator.

* * * * *